US006485317B2

(12) United States Patent
Gundermann et al.

(10) Patent No.: US 6,485,317 B2
(45) Date of Patent: Nov. 26, 2002

(54) CONNECTOR WITH LEVER

(75) Inventors: James E. Gundermann, Palmyra, PA (US); Michael J. Engler, Kernersville, NC (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 09/990,173

(22) Filed: Nov. 20, 2001

(65) Prior Publication Data

US 2002/0031928 A1 Mar. 14, 2002

Related U.S. Application Data

(63) Continuation of application No. 09/617,404, filed on Jul. 17, 2000, now Pat. No. 6,368,125, which is a continuation-in-part of application No. 09/313,875, filed on May 18, 1999, now Pat. No. 6,099,330.

(51) Int. Cl.[7] ..... H01R 13/62

(52) U.S. Cl. ..... 439/157; 439/372

(58) Field of Search ..... 439/157, 372, 439/152–156, 158–160, 341

(56) References Cited

U.S. PATENT DOCUMENTS

| | | | | |
|---|---|---|---|---|
| 5,257,942 | A | 11/1993 | Taguchi | 439/157 |
| 5,711,682 | A | 1/1998 | Maejima | 439/157 |
| 5,722,843 | A | 3/1998 | Kerckhof et al. | 439/157 |

*Primary Examiner*—Tho D. Ta
(74) *Attorney, Agent, or Firm*—Brinks Hofer Gilson & Lione

(57) ABSTRACT

A connector assembly is provided that includes first and second mating connector housings. A lever is attached to the first connector housing to facilitate sliding engagement between the housings. The second housing and the lever include respective cam projections that mate in an alignment mode of operation thereby permitting the lever to be pivoted to bring the housings together. When the housings are not properly aligned, respective cam projections engage each other to prevent pivoting of the lever.

6 Claims, 11 Drawing Sheets

CONNECTOR WITH LEVER

This application is a continuation of application Ser. No. 09/617,404, filed Jul. 17, 2000, U.S. Pat. No. 6,368,125 which is hereby incorporated by reference herein.

This application is a continuation-in-part of commonly assigned, application Ser. No. 09/313,875, filed May 18, 1999, now U.S. Pat. No. 6,099,330 for "Connector With Lever".

TECHNICAL FIELD

The present invention relates to a connector assembly, and more particularly to a connector assembly that includes a male connector housing and a female connector housing that are slidably engageable. A lever is pivotally supported by one of the connector housings to facilitate engagement and disengagement thereof. Operation of the lever mechanically assists the mating of the connector housings to overcome high insertion force.

BACKGROUND ART

The mating of male and female connectors to form a connector assembly often involves a high insertion force. This is particularly true when the connectors comprise mating connector housings containing many contacts. For example, automobile wiring systems typically include wiring harnesses. Each harness contains many conductors that are electrically and mechanically connected to respective contacts contained in the harness connector housing. The harness connector housing and the plurality of contacts contained therein are mated with a header connector housing and the contacts contained therein. In such applications, the mating of the harness and header connector housings is often difficult due to the force required to overcome the friction between the mating contacts.

Many attempts have been made using levers to overcome high insertion force when mating male and female connector housings. Some attempts have required that the lever include slits or grooves therein or therethrough that engage pins that extend outwardly from one of the connector housings. Such slits or grooves tend to weaken the lever as well as cause more flexing thereof during use than desired. Some attempts require that the pivoting and camming elements be located on the outside of the connector assembly. The use of pivoting and camming elements external of the connector assembly is undesirable. Such pivot and camming elements prevent a smooth seal and therefore are not useful in a sealed connector environment. Another problem incurred is that there is a tendency in some connector assemblies for the lever to prematurely rotate out of the desired assembly position. A further concern is that in those applications wherein multiple connectors are stacked upon each other, there is a tendency for the latch that secures the lever in place when the connector housings are mated, to fail. Another concern is that due to the flexible nature of the material commonly used in fabricating known connector assemblies, there is a tendency for the joined connector housings to become inadvertently locked together when they are not properly aligned and are forced together. In such instances it may be impossible to unmate the connector housings without causing damage to one or both of the housings. In some known connector assemblies, misaligned connector housings may not be detected by the user until they are already locked together.

An example of one prior art connector assembly is U.S. Pat. No. 5,322,383 that issued on Jun. 21, 1994 to Saito et al. This patent relates to a lever-type connector including two housings wherein a lever is pivotally connected by pivot shafts to one of the housings to provide leverage during mating of the two. In such embodiment, it is necessary to provide cam grooves in opposing inner surfaces of the lever. The grooves mate with respective guide pins to facilitate engagement of the connectors. A similar device is described in U.S. Pat. No. 5,172,998 that issued on Dec. 22, 1992 to Hatagishi. In the Hatagishi embodiment, opposing cam slits extend completely through the lever.

In U.S. Pat. No. 3,300,751 that issued on Jan. 24, 1967 to Fraley, a lever is provided to facilitate the mating of connector elements, such lever including a slot that extends through the lever. The lever is attached to a top plate by a screw extending outwardly of a top section of the top plate. Another screw mates with the slot to facilitate movement of the connector elements. Each screw is external of the device.

In U.S. Pat. No. 5,564,935 that issued on Oct. 15, 1996 to Yagi et al., a connector engagement device is illustrated that includes two lever-type cam members pivoted upon respective externally extending pins. Each cam member includes cam grooves that mate with externally extending pins. The cam members are also provided with teeth that mesh so that the two cam members can be operated interlock with each other in directions different from each other.

DISCLOSURE OF THE INVENTION

It is an object of the present invention to provide an improved connector assembly.

Another object of the present invention is to obviate the disadvantages of the prior art.

A further object of the present invention is to provide a connector assembly that includes a lever that is mounted externally of mated connector housings and camming features that are located within the connector assembly.

Yet another object of the present invention is to provide a connector assembly that includes a lever that is mounted externally of mated connector housings and lever pivot elements that do not extend outwardly from the connector assembly.

Another object of the present invention is to provide a connector assembly that includes a lever that does not include camming features in the form of grooves or slits therein or therethrough.

Yet another object of the present invention is to provide a connector assembly that includes a lever that will not rotate prematurely out of the desired assembly position.

Another object of the present invention is to provide a connector assembly that may be stacked with one or more other connector assembly without failure of the latch that secures the lever in place when mating connector housings are fully engaged.

A further object of the present invention is to provide a connector assembly wherein the likelihood of mismating connector housings is minimized.

Yet another object of the present invention is to provide a connector assembly that provides tactile feedback to the user thereof if the connector housings are not properly aligned.

The present invention achieves these and other objects in a first embodiment by providing a connector assembly that includes at least one first connector housing and at least one second connector housing slidably engaging within the first connector housing. The second connector housing comprises a first and second cam projection. A lever is pivotally supported on the first connector housing by at least one pivot element extending through a wall of the first connector housing. The lever comprises at least one lever portion adapted (a) to engage a wall of the first connector housing in a first lever position to prevent pivotal movement of the lever, and (b) to be disengaged from the wall of the first connector housing by a first cam projection in a second lever position to permit pivotal movement of the lever. The pivot element comprises a first region that comprises a cam follower adapted to engage a second cam projection in an engagement and disengagement mode when the lever is pivoted in an engagement direction or in an opposite disengagement direction, respectively, to urge the first and second connector housings towards or away from each other, respectively.

In a second embodiment of the present invention a connector assembly is provided that comprises at least one first connector housing and at least one second connector housing slidably engaging within the first connector housing. The second connector housing comprises a multi-surface first cam projection. A lever is provided that is pivotally supported on the first connector housing by at least one pivot element extending through a wall of the first connector housing. The pivot element comprises a first region that includes a multi-surface second cam projection. The first and second cam projections are structured and arranged so that (a) at least a first surface area of the first cam projection will engage at least a first surface area of the second cam projection, when the first and second connector housings are in a misalignment mode thereby preventing pivoting of the lever in an engagement direction; (b) at least a second surface area of the first cam projection will mate with at least a second surface area of the second cam projection when the first and second connector housings are in a first stage of an alignment mode thereby permitting pivoting of the lever in the engagement direction; and (c) at least a third surface area of the first cam projection will mate with the first surface area of the second cam projection when the lever is pivoted in an engagement direction or in an opposite disengagement direction, respectively, in a second stage of the alignment mode, to urge the first and second connector housings towards or away from each other, respectively.

BRIEF DESCRIPTION OF THE DRAWINGS

This invention may be clearly understood by reference to the attached drawings in that like reference numerals designate like parts and in that.

BEST MODE FOR CARRYING OUT THE INVENTION

Figure 1:
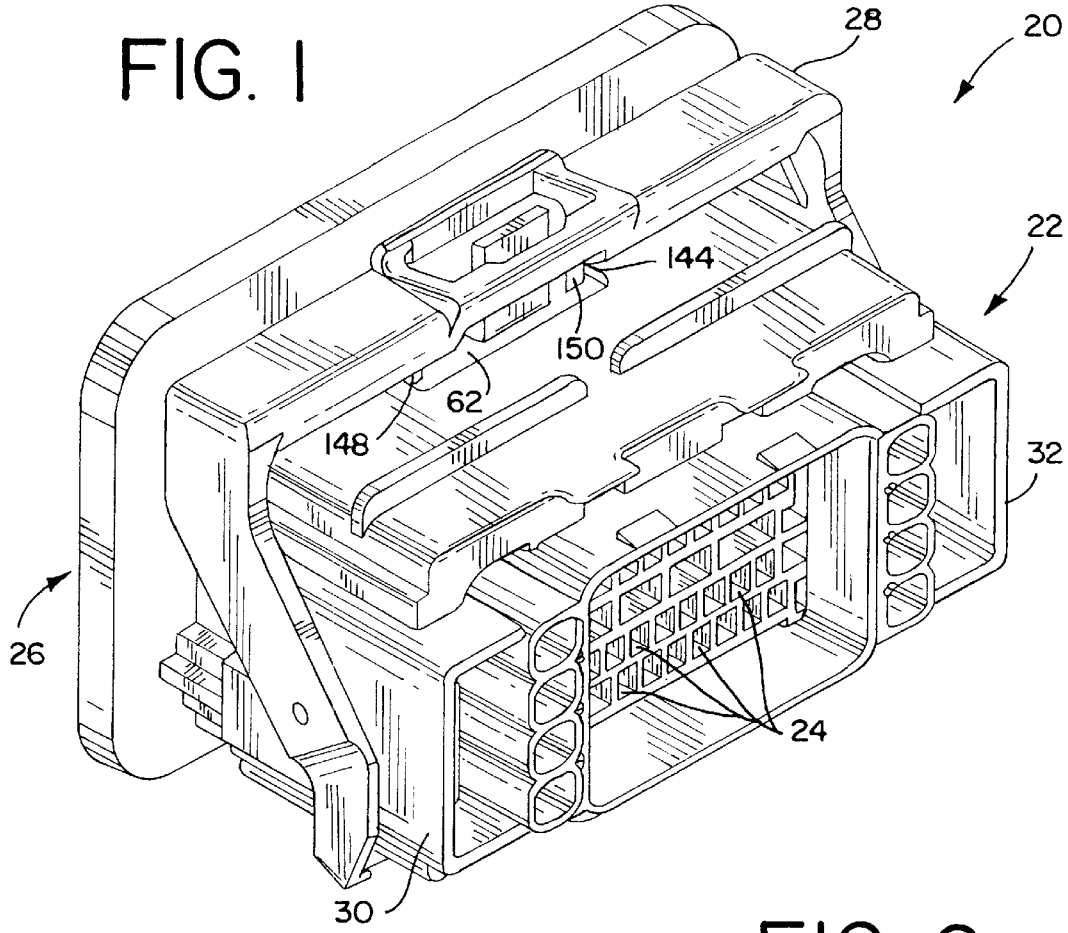
FIG. 1 is an a perspective view of one embodiment of the connector assembly of the present invention.

For a better understanding of the present invention, together with other and further objects, advantages and capabilities thereof, reference is made to the following disclosure and appended claims taken in conjunction with the above-described drawings.

In one embodiment of the present invention, the connector assembly includes at least one first connector housing and at least one second connector housing slidably engaging a respective first connector housing. Each first connector housing supports a lever for urging such first connector housing and a mating second connector housing towards and away from each other, as desired. For example, in the embodiment illustrated in FIG. 1, a connector assembly 20 is provided. Without limitation, connector assembly 20 may be of the type used in automobile wiring systems wherein a bundle of wires forming a conventional wiring harness are electrically and mechanically connected to respective contacts housed in a harness connector housing that is adapted for connection to a header connector housing. The header connector housing houses contacts that mate with the contacts in the harness connector housing when the harness and header connector housings are mated with each other. In the embodiment illustrated in FIG. 1, the connector assembly 20 includes a harness connector housing 22 that includes a plurality of openings 24 structured and arranged to contain respective male or female contacts (not shown) electrically and mechanically connected to respective wires of a wiring harness in a conventional manner. A header connector housing 26 is also provided. Like harness connector housing 22, header connector housing 26 includes a plurality of openings (not shown) that contain respective female or male contacts that mate with respective male or female contacts contained within the harness connector housing 22 when the harness and header connector housings are mated with each other as described herein. In one embodiment, the harness and header connector housings 22, 26 may each contain thirty eight contacts on 0.64 mm centers. The friction generated when attempting to connect or disconnect such male and female contacts is sufficiently high to render such task very difficult. To facilitate connection or disconnection, a lever 28 is supported on the harness connector housing 22 for urging the harness and header connector housings 22, 26 towards and away from each, as described herein. The connector assembly 20 is particularly suited to connectors used in a sealed system.

Figure 2:
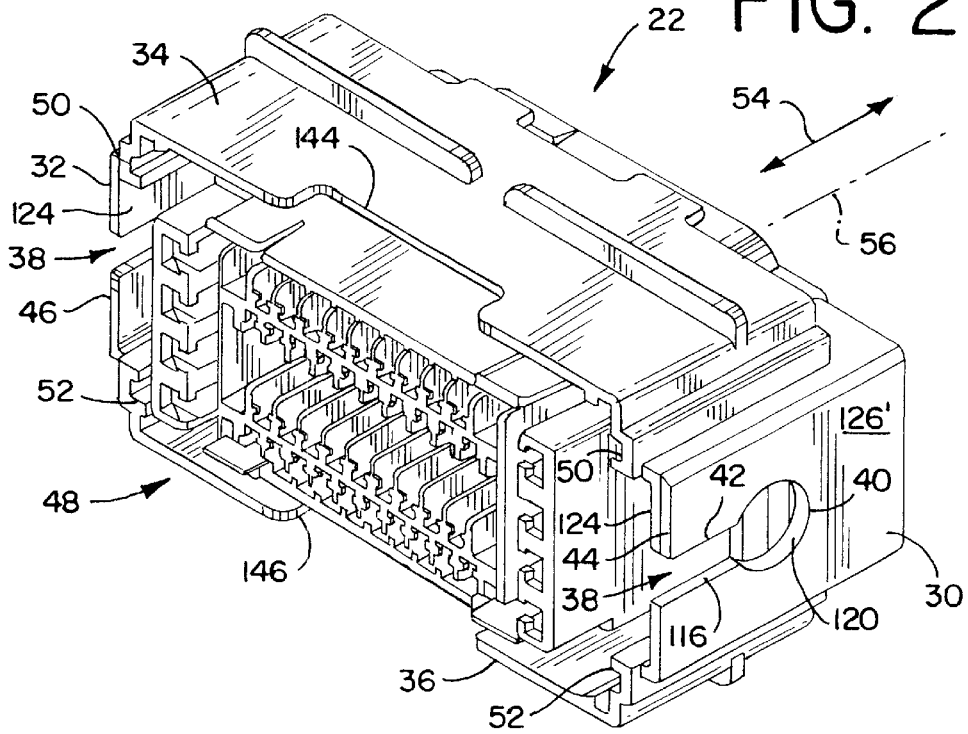
FIG. 2 is a perspective view of a first connector housing of the connector assembly of FIG. 1

The details of the harness connector housing 22 are illustrated in FIG. 2. Harness connector housing 22 includes opposing sidewalls 30 and 32 and opposing top and bottom walls 34 and 36, respectively. Although not necessary, the harness connector housing 22 is symmetrical and to this end, sidewall 30 is identical to sidewall 32, top wall 34 is identical to bottom wall 36 and the internal features of the housing are symmetrical throughout. As such, the housing 22 may be used as illustrated in FIG. 2 or may be inverted such that wall 34 serves as the bottom wall and wall 36 serves as the top wall.

Sidewalls 30 and 32 each comprise an aperture 38 extending therethrough. Aperture 38 comprises a circular portion 40 that is intersected by a linear portion 42. The width of the linear portion 42 is less than the diameter of the circular portion 40. Linear portion 42 extends from the circular portion 40 to respective edges 44, 46 of sidewalls 30 and 32. The header connector housing 26 is inserted into the harness connector housing 22 at the end 48 of the harness connector housing. To facilitate such insertion as described herein, the harness connector housing 22 comprises two elongated upper grooves 50 and two elongated lower grooves 52 that extend within the harness connector housing in the direction 54 of a longitudinal axis 56 of the harness connector housing.

Figure 3:
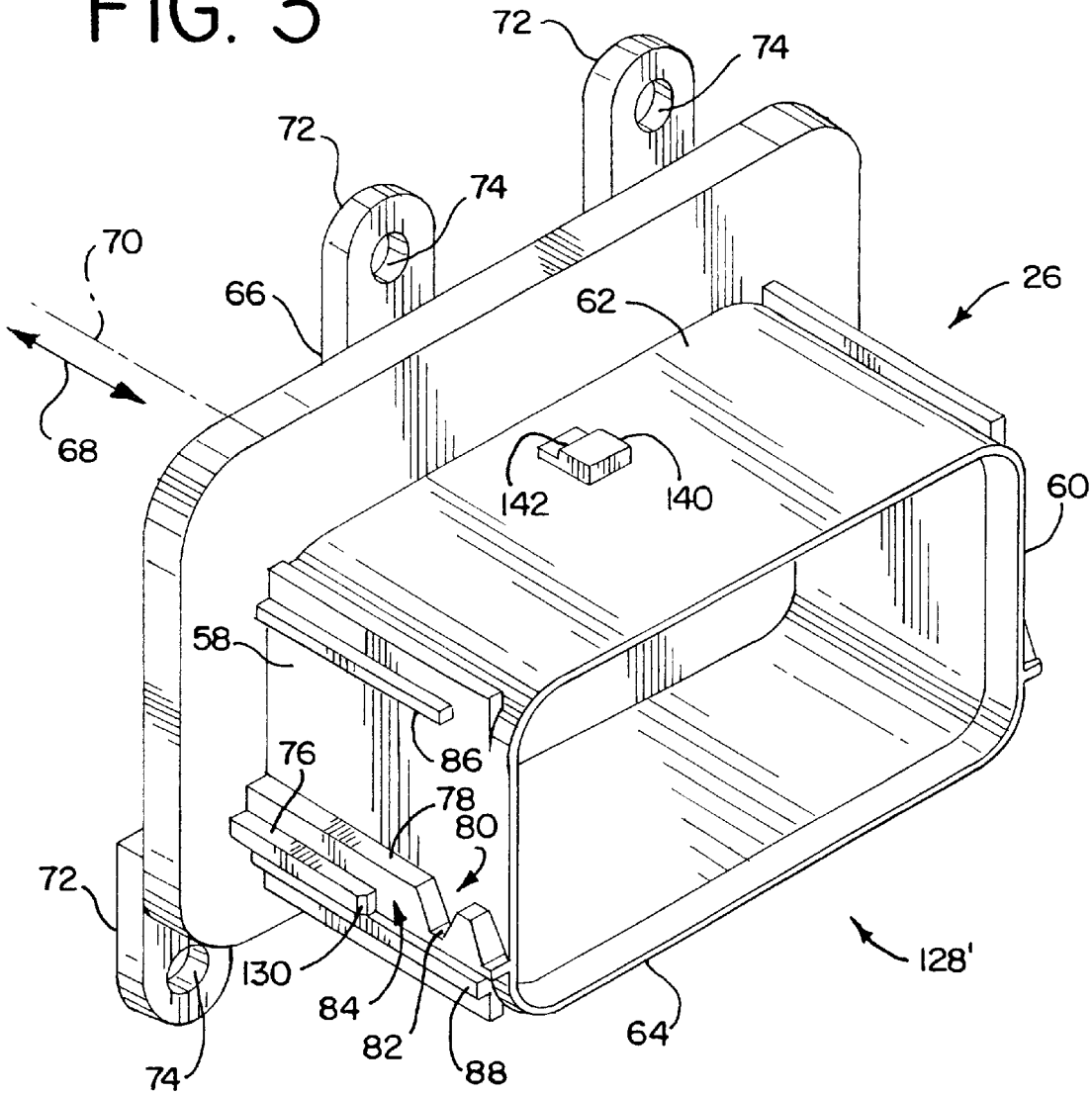
FIG. 3 is a perspective view of a second connector housing of the connector assembly of FIG. 1.

The details of the header connector housing 26 are illustrated in FIG. 3. Header connector housing 26 includes opposing sidewalls 58 and 60 and opposing top and bottom walls 62 and 64. Although the embodiment illustrated in FIG. 3 is not symmetrical throughout, sidewalls 58 and 60 are identical. However, if desired the entire housing 26 may be fabricated to be symmetrical throughout so that, like harness connector housing 22, the header connector housing 26 may be used as illustrated in FIG. 3 or may be inverted such that wall 62 serves as the bottom wall and wall 64 serves as the top wall.

In the embodiment illustrated in FIG. 3, the walls 58, 60, 62 and 64 extend from a mounting plate 66 in the direction 68 of a longitudinal axis 70 of the header connector housing 26. The mounting plate 66 includes a plurality of mounting tabs 72 having respective apertures 74 therethrough. The header connector housing 26 may be mounted to a surface such as an automobile panel by inserting screws through apertures 74 and into the panel in a conventional manner.

The connector assembly 20 may comprise one or more harness connector housings 22 and header connector housing 26. For example, in the embodiment illustrated in FIG. 3, there is one header connector housing 26 extending from the mounting plate 66 to that one harness connector housing 22 may be mated as illustrated in FIG. 1 and described hereinafter. If desired, mounting plate 66 may be elongated sufficiently so that two or more header connector housings 26 may extend therefrom, each having a respective harness connector housing 22 attachable thereto as described herein.

The sidewalls 58 and 60 each comprise a first cam projection 76 and a second cam projection 78. Each cam projection 78 projects from a respective sidewall 58, 60, extends in the direction 68 and comprises a generally V-shaped camming surface area 80 that includes a base portion 82. Each surface area 80 has a gear-like configuration. Each cam projection 76 projects from a respective cam projection 78, extends in the direction 68 and includes a camming surface area 84. The header connector housing 26 comprises elongated upper ribs 86, and elongated lower ribs 88, that extend along the outer surfaces of the sidewalls 58 and 60 in the direction 68. Ribs 86 and 88 are structured and arranged to mate with and slide within grooves 50 and 52, respectively, to facilitate the insertion of the header connector housing 26 into the harness connector housing 22 by facilitating alignment of the two housings when they are mated as described herein.

With reference to FIG. 1, the lever 28 is pivotally supported on the sidewalls 30 and 32 of the harness connector housing 22 by respective first and second pivot elements extending through respective sidewalls 30, 32, as described hereinafter. The details of the lever 28 are illustrated in FIGS. 4 to 7.

Lever 28 comprises opposing first and second resilient arms 90, 92 that are joined by a bridge segment 94. Each arm 90, 92 comprises a pivotal element 96 projecting from a respective inner arm surface 98, 100. Each arm 90, 92 of the lever 28 extends from the bridge segment 94 to a respective distal end that comprises opposing first and second end portions 102. The distance between the end portions 102 is less than the distance between the outer surfaces of the sidewalls 30 and 32.

Each pivotal element 96 comprises a region 104 that includes opposing flat segments 106 connected by opposing circular segments 108. Each pivotal element 96 also comprises a region 110 that includes a cam follower in the form of a generally V-shaped camming surface area 112 that includes a base portion 114. Each surface area 112 has a gear-like configuration and is structured and arranged to mesh with a respective V-shaped camming surface area 80 that projects from sidewalls 58 and 60 of the header connector housing 26.

Figure 8:
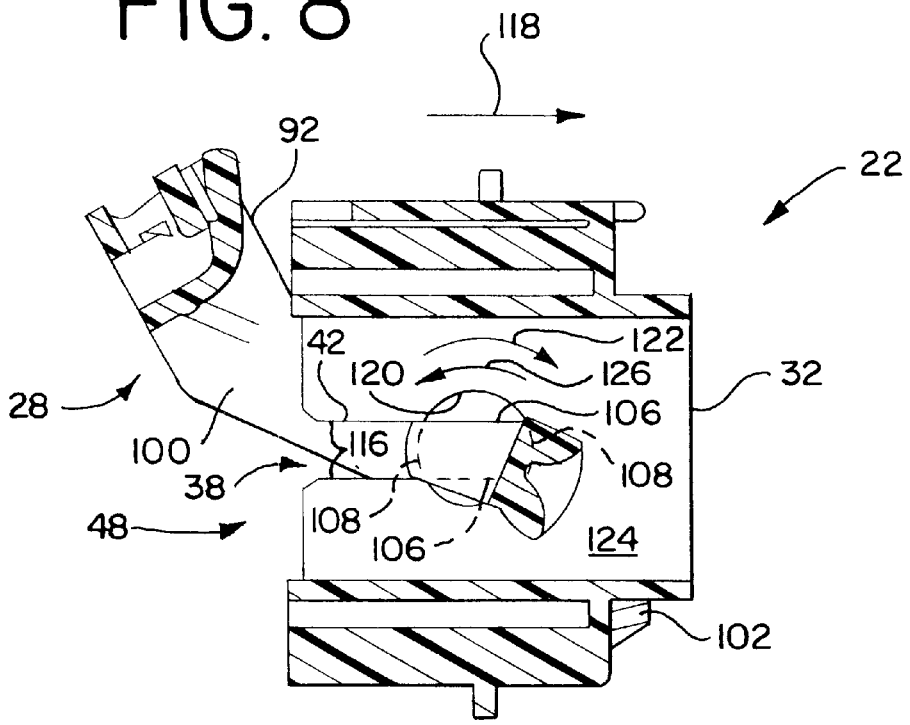
FIGS. 8 and 9 sequentially illustrate attachment of the lever of FIG. 1 to the first connector housing.
Figure 9:
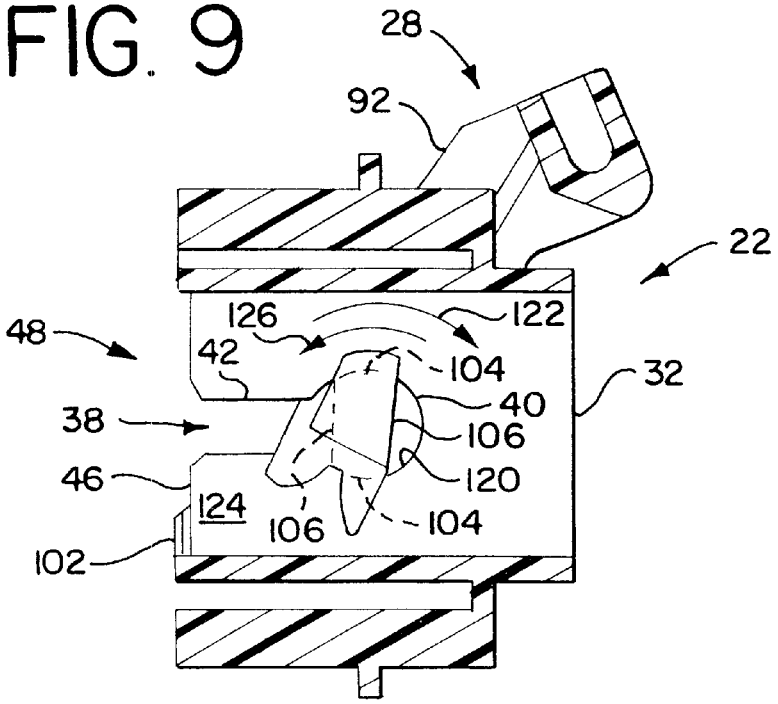

The lever 28 is pivotally supported by sidewalls 30, 32 of the harness connector housing 22 in such a manner that each region 110 of each pivotal element 96 is positioned within the harness connector housing between sidewalls 30, 32, and the arms 90, 92 and bridge segment 94 are positioned outside of the harness connector. To accomplish such structural relationship, the lever 28 is attached to the harness connector 22 in the following manner. With reference to FIGS. 2 and 8, resilient arms 90, 92 are urged apart so that they engage and bear against the outer surface of sidewalls 30 and 32. The distance between the end portions 102 relative to the distance between the outer surfaces of the sidewalls 30, 32 is dimensioned such that the arms 90, 92 do not require a great deal of deflection to be caused to bear against the sidewalls. The region 104 of each pivotal element 96 is then inserted into a respective aperture 38 in sidewalls 30, 32 such that opposing flat segments 106 mate with the opposing edges 116 of the linear portion 42 of aperture 38. The region 104 is caused to slide along the linear portion 42 in direction 118 until a circular segment 108 of the region 104 engages the wall 120 of the circular portion 40 of the aperture 38 as illustrated in FIG. 8. The lever 28 is then rotated in a disengagement direction 122, the opposing circular segments 108 engaging the wall 120 during such rotation, as illustrated in FIG. 9. Such movement of the lever 28 rotates each region 104 within a respective circular portion 40 of a respective aperture 38. Each region 110 will be disposed inside of the harness connector housing 22 adjacent an inner surface 124 of a respective wall 30, 32, and the lever arms 90, 92 will be disposed outside of the harness connector housing adjacent an outer surface 126' of a respective wall 30, 32. The lever 28 is rotated in direction 122 until the end portions 102 engage respective edges 44 and 46 of sidewalls 30 and 32 as illustrated in FIG. 9 with respect to end portion 102 of lever arm 92. When the end portions 102 engage respective sidewalls 30, 32 in this manner, the lever will be in a first lever position wherein pivotal movement of the lever will be prevented. In particular, the abutment of respective end portions 102 against edges 44 and 46, respectively, will prevent rotation of the lever 28. As a practical matter, the lever 28 will be prevented from rotating until the header and harness connector housings engage each other as described herein. The lever 28 and harness connector housing 22 are now pre-assembled and ready for attachment to the header connector housing 26. It should be noted that the bridge segment 94 of lever 28 is near the rear of the harness connector housing 22.

The harness and header connector housings 22 and 26 are mated together by inserting the end 128' of the header connector housing into the end 48 of the harness connector housing. To this end, ribs 86 and 88 are inserted into respective grooves 50 and 52 to properly align the housings 22, 26. As the housing 26 is inserted into the housing 22, the camming surface areas 84 engage respective end portions 102 and urge such end portions apart in a second lever position. In particular, the end portions 102 are sufficiently disengaged from the opposing sidewalls 30, 32 by the camming surface areas 84 of the cam projections 76 to permit the end portions 102 to clear the edges 44 and 46 sufficiently to permit pivotal movement of the lever 28 in an engagement direction 126.

Figure 12:
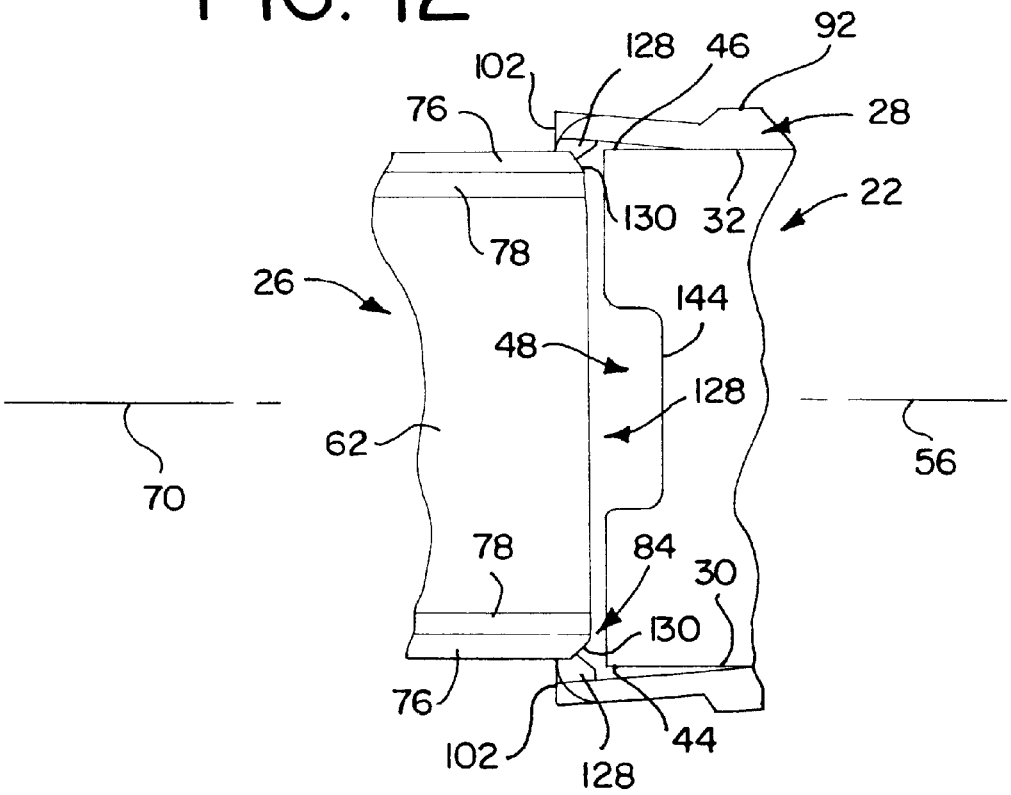
FIG. 12 is a partial plan view of the first and second connector housings of FIG. 1 during the mating thereof.
Figure 13:
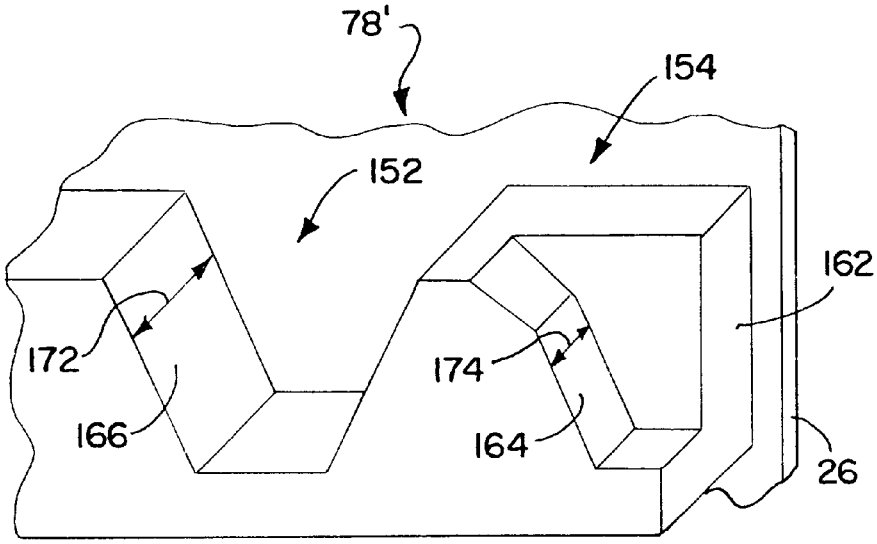
FIG. 13 is a perspective view of a portion of a second connector housing of a second embodiment of the present invention.
Figure 14:
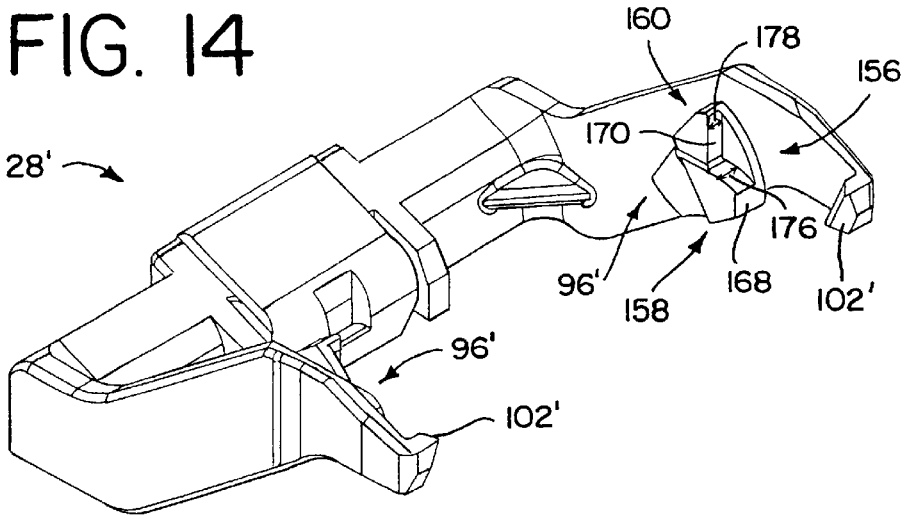
FIG. 14 is a top perspective view from one end of a lever of the second embodiment of the present invention.
Figure 15:
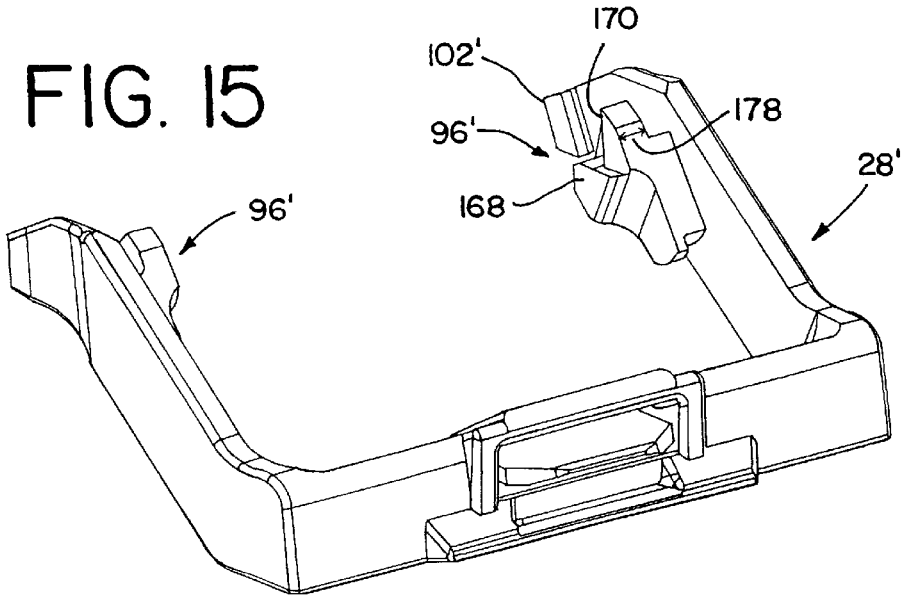
FIG. 15 is a bottom perspective view from the opposite end of the lever illustrated in FIG. 14.
Figure 16:
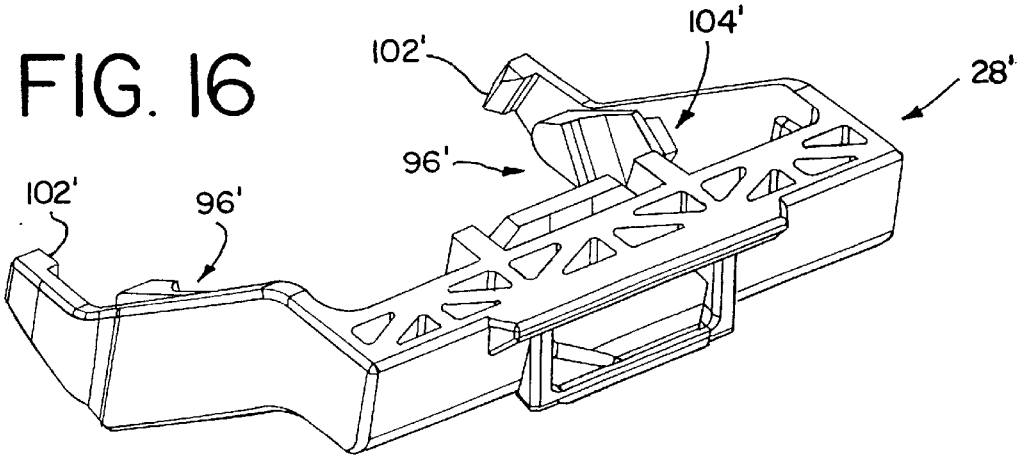
FIG. 16 is a bottom perspective view of the lever illustrated in FIG. 14.
Figure 17:
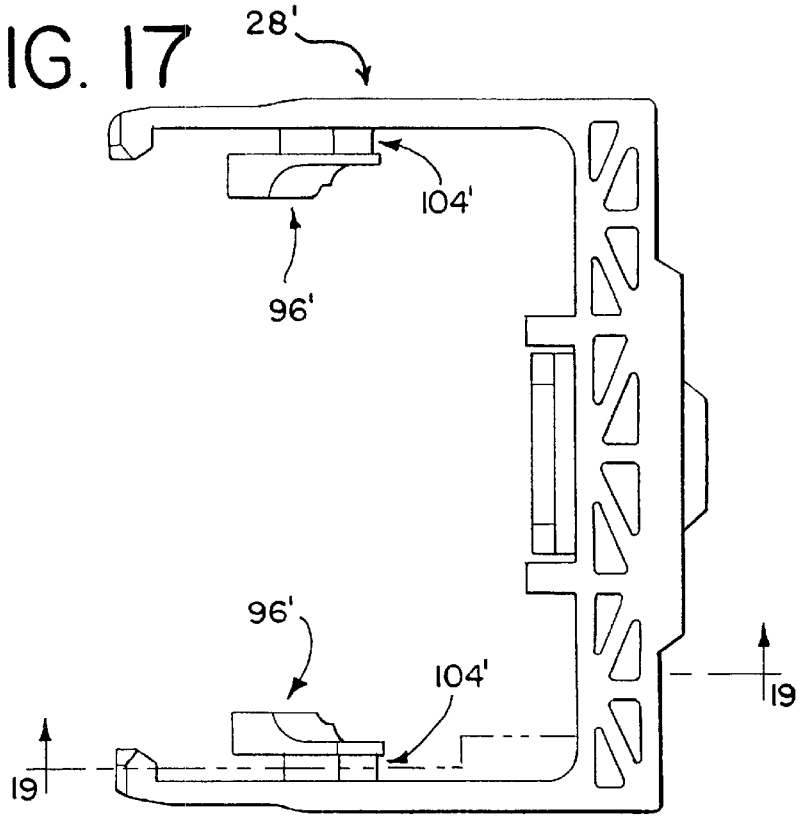
FIG. 17 is a bottom view of the lever of FIG. 14.
Figure 18:
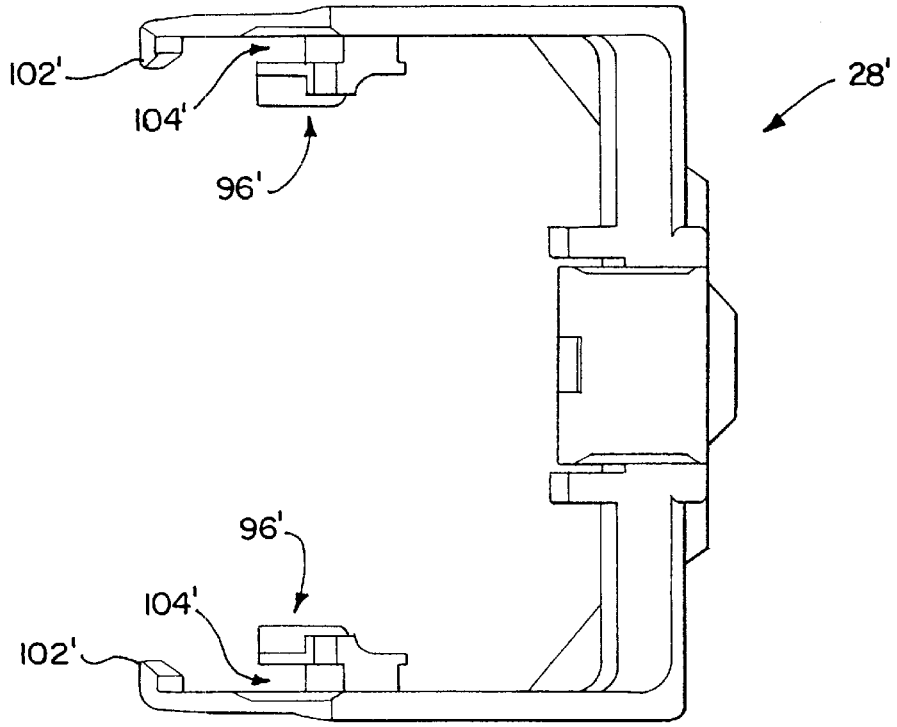
FIG. 18 is a top view of the lever of FIG. 14.
Figure 19:
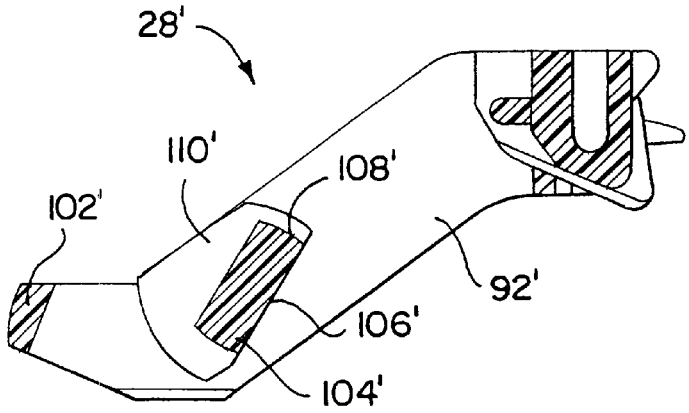
FIG. 19 is a view of FIG. 17 taken along lines 19—19.
Figure 20:
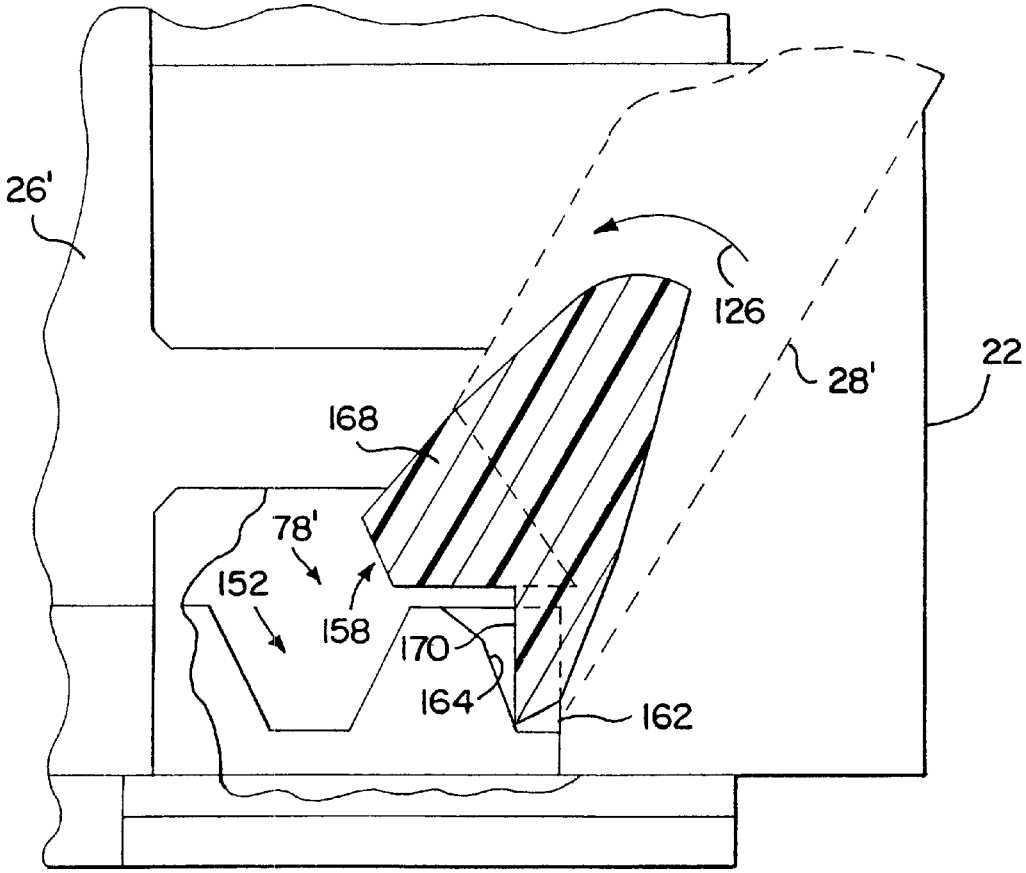
FIG. 20 illustrates the first stage of an alignment mode during operation of the connector assembly of the second embodiment of the present invention.
Figure 21:
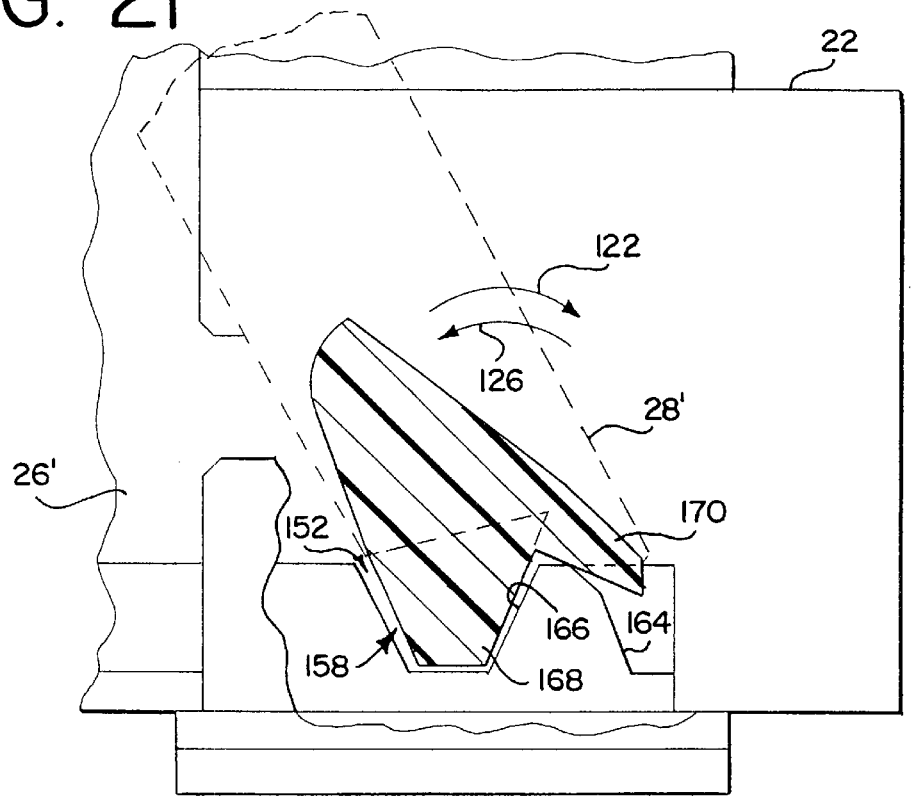
FIG. 21 illustrates the second stage of the alignment mode during operation of the connector assembly of the second embodiment of the present invention.
Figure 22:
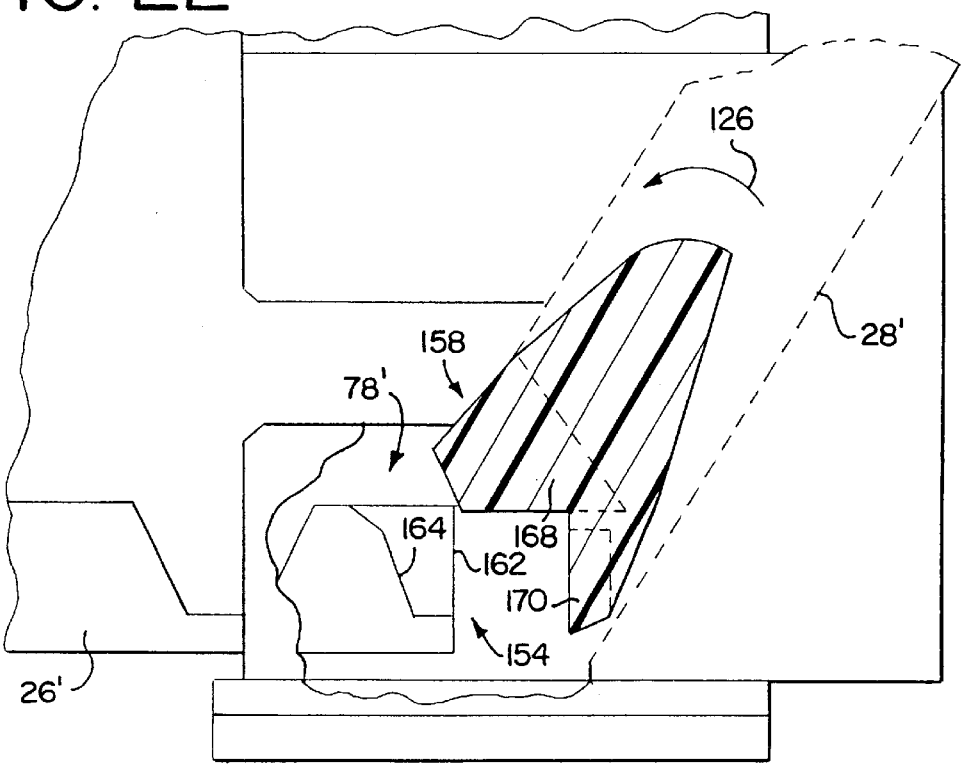
FIG. 22 illustrates a misalignment mode during operation of the connector assembly of the second embodiment of the present invention.

With reference to FIG. 12, in order to facilitate the movement of the end portions 102 away from each other, each end portion may comprise a beveled surface 128, and each camming surface area 84 may comprise a beveled surface 130. In such an embodiment, when the housing 26 is inserted into housing 22, each beveled surface 128 slides upon a respective beveled surface 130 causing end portions 102 to be cammed away from each other. It will be noted that in the embodiment illustrated in the drawings, when the harness and header connector housings 22, 26 are being urged together, the axes 56 and 70 will be coincident, and the end portions 102 will be cammed away from such axes.

Figure 10:
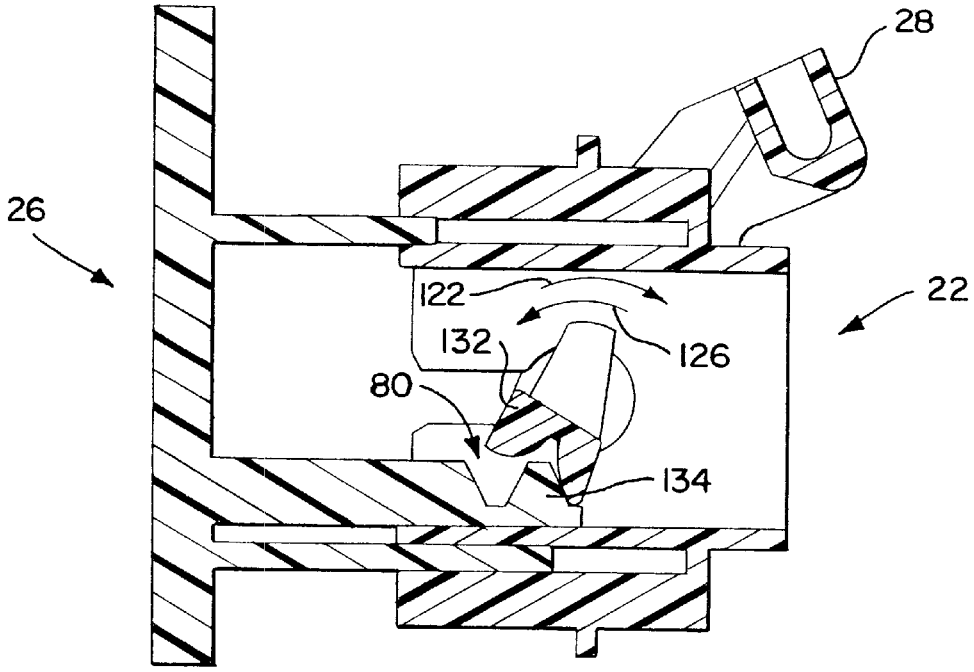
FIGS. 10 and 11 sequentially illustrate engagement/disengagement of the first connector housing of FIG. 1 relative to the second connector housing.
Figure 11:
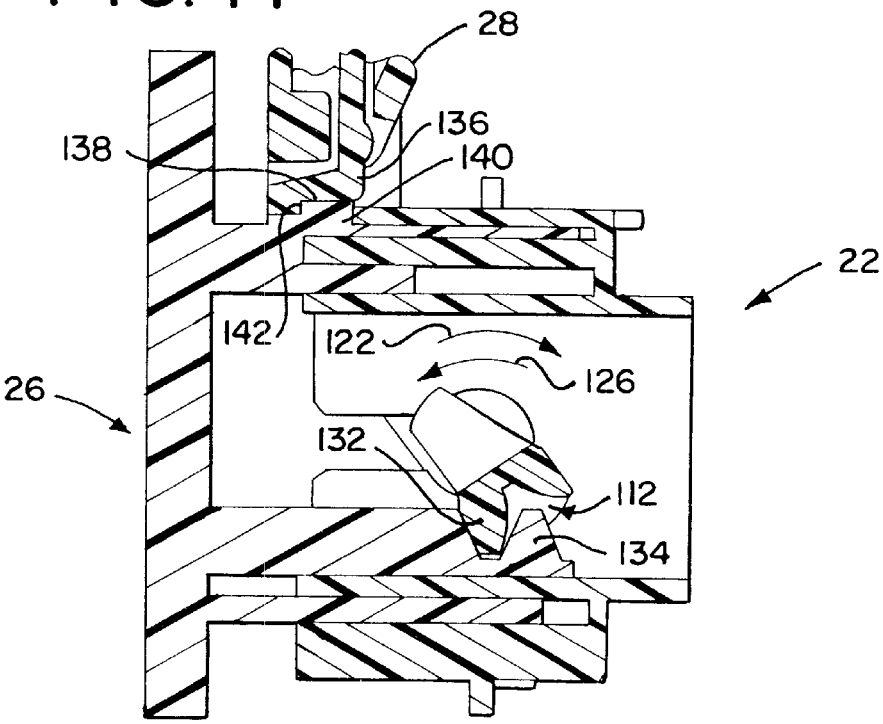

The cam followers in the form of the generally V-shaped gear-like surface area 112 are adapted to engage respective generally V-shaped gear-like camming surface areas 80 of the cam projection 78 so that by pivotal operation of the lever 28 the harness and header connector housings 22 and 26 will be urged towards or away from each other when the lever is pivoted in an engagement direction towards the header connector or in a disengagement direction away from the header connector. For example, after the end portions 102 have been cammed away from each other by respective camming surface areas 84, the harness connector housing can be partially pushed towards the header connector housing causing the lever 28 to rotate sufficiently in direction 126 to alert the user that the lever may be engaged. Such rotation causes each surface area 112 of lever 28 to begin to mesh or mate with a respective surface area 80 of the header connector housing 26 as illustrated in FIG. 10. The user next continues rotation of the lever 28 by pushing against the bridge segment 94. Since bridge segment 94 is near the rear of the harness connector housing 22, the lever and harness connector housing move in the same general direction during this step. Such continued rotation of lever 28 in direction 126 causes the tooth 132 to fully mesh with a respective camming surface area 80. During such rotation, the interaction between each tooth 132 and a respective camming surface area 80 urges the harness and header connector housings 22, 26 together as illustrated in FIG. 11. When the lever can no longer be rotated in direction 126, the contacts in the respective housings will be fully mated in a conventional manner.

If it is desired to disconnect the housings 22 and 26, the lever is rotated in direction 122. Such rotation causes each tooth 134 of each respective camming surface area 80 to fully mesh with a respective surface area 112. During such rotation, the interaction between each tooth 134 and a respective surface area 112 urges the harness and header connector housings 22, 26 apart as illustrated in FIG. 10. The end portions 102 of arms 90, 92 prevent the lever 28 from pivoting sufficiently in direction 122 to its preassembled position where the end portions 102 engage respective edges 44 and 46.

Figure 4:
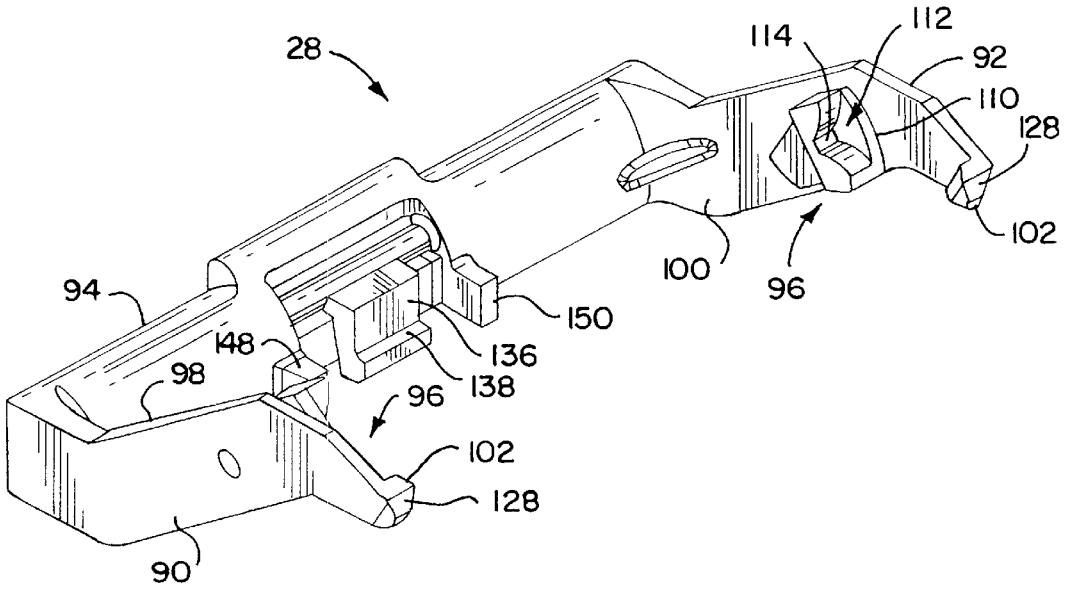
FIG. 4 is a top perspective view of the lever illustrated in FIG. 1.
Figure 5:
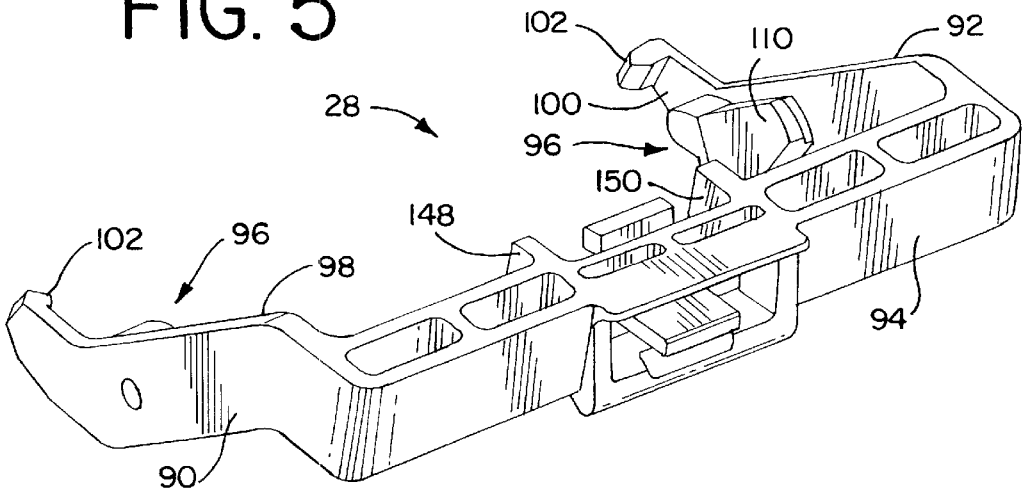
FIG. 5 is a bottom perspective view of the lever illustrated in FIG. 1.
Figure 6:
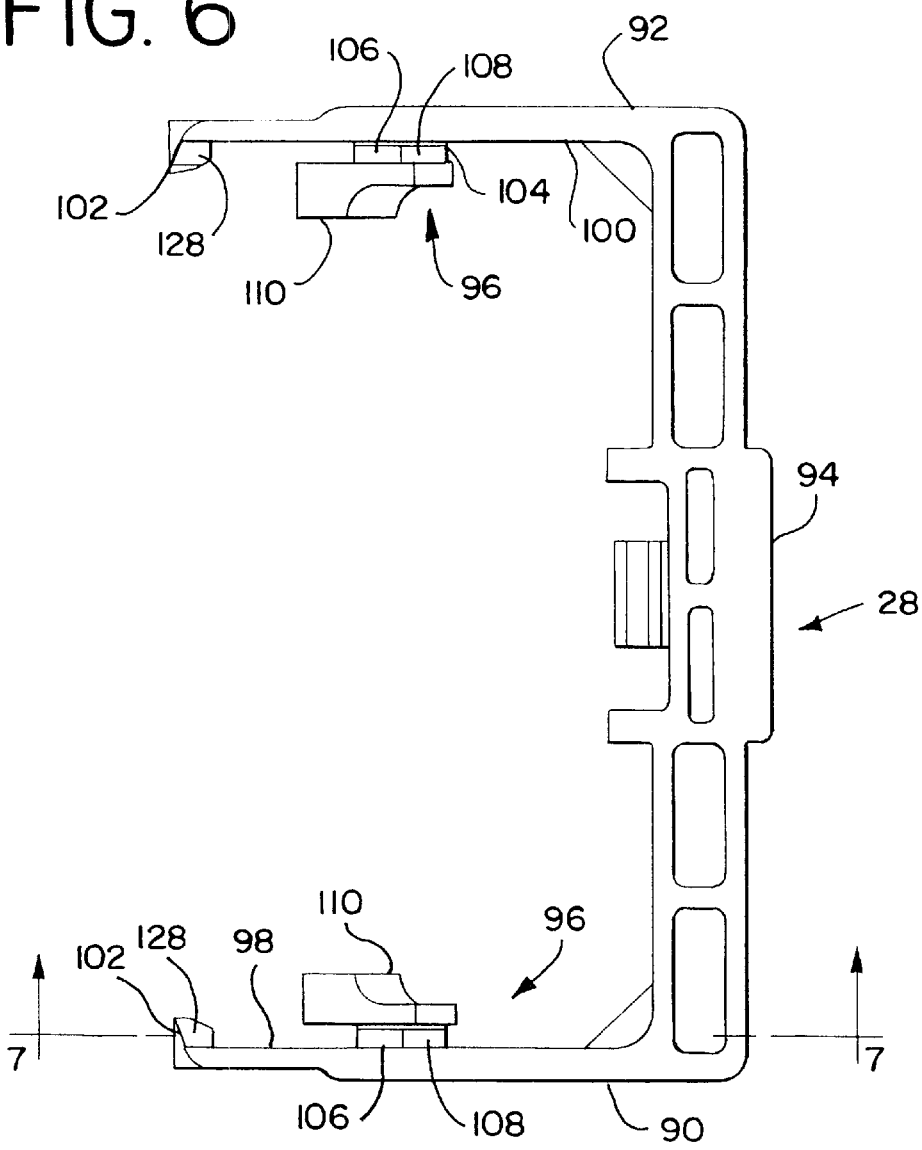
FIG. 6 is a top view of the lever of FIGS. 4 and 5.
Figure 7:
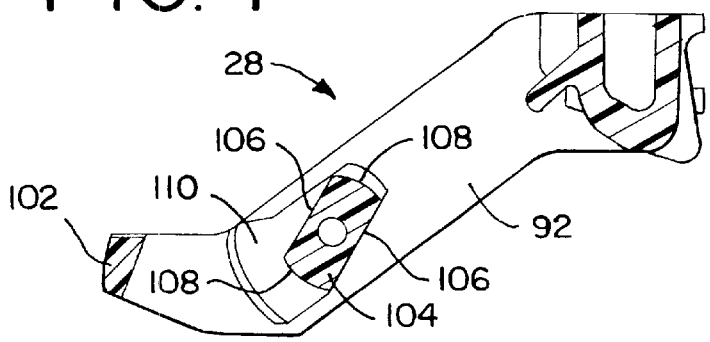
FIG. 7 is a sectional view of FIG. 6 taken along lines 7—7.

With reference to FIGS. 4 and 5, the bridge segment 94 of the lever 28 comprises a resilient latch member 136 including an engagement surface 138. With reference to FIG. 3, the top wall 62 of the header connector housing 26 comprises a mating latch member 140 including a mating engagement surface 142. The latch member 136 and mating latch member 140 are structured and arranged to fully engage each other, when the connector housings 22, 26 are fully engaged, to thereby lock the connector housings in place relative to each other. In particular, with reference to FIG. 11, the resilient latch member 136 will snap into place relative to the mating latch member 140 so that the engagement surface 138 engages the mating engagement surface 142 when the contacts of the connector housings 22 and 26 are engaged sufficiently to assure proper electrical connection. When the latch member 136 and mating latch member 140 snap together, the engagement surface 138 will bear against the mating engagement surface 142. The latch member 136 may be disengaged so that the lever 28 may be rotated in direction 122 by depressing the latch member so that the surface 138 disengages surface 142.

In the embodiment illustrated in FIG. 2, the top and bottom walls 34 and 36 of the harness connector housing 22 include recesses 144 and 146 adjacent end 48. With reference to FIGS. 4 and 5, the bridge segment 94 of the lever 28 comprises first and second beams 148 and 150 that extend from the bridge segment. The beams 148 and 150 are structured and arranged such that when the connector housings 22 and 26 are fully engaged, the distal ends of the beams will extend into the recess 144 and engage the top wall 62 of the connector housing 26 as illustrated in FIG. 1. Such beams prevent the bridge segment 94 of the lever 28 from being forced into engagement with the latch 136 when a plurality of connector housings 20 are stacked upon each other . As a result, the latch 136 is isolated from tolerance stackup problems.

A second embodiment of the present invention includes features that minimize the likelihood of mismating the first and second connector housings. In such embodiment, a connector assembly is provided that includes a first connector housing and a second connector housing slidably engaging therein. The second connector housing includes a multi-surface first cam projection. A lever is pivotally supported on the first connector housing by at least one pivot element extending through a wall of the first connector housing. In such embodiment, the pivot element comprises a region that comprises a multi-surface second cam projection. The first and second cam projections are structured and arranged so that at least a first surface area of the first cam projection will engage at least a first surface area of the second cam projection when the first and second connector housings are in a misalignment mode thereby preventing pivoting of the lever in an engagement direction. The first and second cam projections are further structured and arranged so that at least a second surface area of the first cam projection will mate with at least a second surface area of the second cam projection, when the first and second connector housings are in a first stage of an alignment mode, to permit pivoting of the lever in the engagement direction. The first and second cam projections are further structured and arranged so that in a second stage of the alignment mode a third surface area of the first cam projection will mate with the first surface area of the second cam projection when the lever is pivoted in an engagement direction or in an opposite disengagement direction, respectively, to urge the first and second connector housings towards or away from each other, respectively.

FIGS. 13 to 22 illustrate an example of such a second embodiment of the present invention. In considering such an embodiment, the connector housing 26 is altered by replacing the cam projections 78 with the cam projections 78' illustrated in FIG. 13. Such altered connector housing is designated 26' and is structured and functions in the same manner as connector housing 26 except as described herein. Each cam projection 78' comprises a segment 152 and a segment 154. The connector housing 22 may be used with connector housing 26'. The lever 28 is altered by replacing the pivot elements 96 with the pivot elements 96' illustrated in FIGS. 14 to 19. Such altered lever is designated 28' and is structured and functions in the same manner as lever 28 except as described herein. Since the other features of the lever 28' are similar to those of lever 28, some of such features have been designated with like reference numbers that have been primed, for clarity. Each pivot element 96' comprises a region 156 that comprises a segment 158 adapted to mate with a respective segment 152, but not with a segment 154, of connector housing 26'. Region 156 of lever 28' also comprises a segment 160 adapted to mate with a respective segment 154 of connector housing 26'. Segments 154 and 158 are structured and arranged so that each segment 158 will engage a respective segment 154 when the first and second connector housings are in a misalignment mode thereby preventing pivoting of the lever 28' in an engagement direction. Segments 154 and 160 are structured and arranged so that each segment 160 will mate with a respective segment 154 in an alignment mode to permit pivoting of the lever 28' in an engagement direction. Segments 152 and 158 are structured and arranged so that when the connector housings 22 and 26' are properly aligned, each segment 158 will mate with a respective segment 152 in an engagement and disengagement mode when the lever 28' is pivoted in an engagement direction or in an opposite disengagement direction, respectively, to urge the connector housings 22 and 26' towards and away from each other, respectively.

The embodiment illustrated in FIGS. 13 to 19 accomplishes the foregoing by providing the multi-surface first cam projections 78' with (a) a first surface area in the form of a stop surface 162 that forms a portion of the segment 154; (b) a second surface area in the form of a partial gear tooth 164 that forms another portion of the segment 154; and (c) a third surface area in the form of a full gear tooth 166 that forms the segment 152. In addition, the multi-surface second cam projection of region 156 is provided with (a) a first surface area in the form of a full gear tooth 168 that forms the segment 158, and (b) a second surface area in the form of a partial gear tooth 170 that forms the segment 160. The gear teeth 164 and 166 of the connector housing 26' are structured and arranged to mate with respective gear teeth 170 and 168 as described herein. In the embodiment illustrated in FIGS. 13 to 19, each full gear tooth 166 has a width 172, and each partial gear tooth 164 has a width 174 that is about one half of the width 172. Similarly, each full gear tooth 168 has a width 176, and each partial gear tooth 170 has a width 178 that is about one half of the width 176.

In considering the assembling of the embodiment illustrated in FIGS. 13 to 19, the lever 28' is attached to the connector housing 22 in the same manner in that the lever 28 is attached to the connector housing 22. In considering the operation of the embodiment illustrated in FIGS. 13 to 19, the connector housings 22 and 26' are slidably engaged with each other in the same manner in that connector housing 22 and 26 are slidably engaged as discussed above, with the exception that the structural and operational interrelationship between each cam projection 78' of the connector housing 26' and each respective pivot element 96' of the lever 28' attached to connector housing 22 differs from that of the cam projections 78 of the connector housing 26 and the pivot elements 96 of the lever 28, as described hereinafter.

In considering the embodiment illustrated in FIGS. 13 to 19, the cam projections 78' of the connector housing 26', and the lever 28' attached to the connector housing 22, are structured and arranged such that if the connector housings are properly aligned when they are slidably engaged, then each segment 154 will engage a respective segment 160 thereby permitting pivoting of the lever in an engagement direction. To this end, and with reference to FIG. 20, the lever 28', a portion of that is illustrated in phantom lines for clarity, is configured such that when it is attached to the connector housing 22, each full gear tooth 168 will be the forward gear tooth of the connector housing 22 when the connector housings 22, 26' are slidably engaged. The lever 28' and connector housing 26' are further configured such that when the connector housings are properly aligned and slidably engaged, each full gear tooth 168 will be disposed above and will slide past a respective stop surface 162 and respective partial gear tooth 164 allowing each partial gear tooth 170 to mate with a respective partial gear tooth 164. In this manner, respective gear teeth 164 and 170 mesh thereby permitting the lever 28' to be pivoted in engagement direction 126 in the first stage of the alignment mode.

The cam projections 78' and the lever 28' are further structured and arranged such that when the connector housings 22 and 26' are properly aligned, each segment 152 will mate with a respective segment 158 when the lever 28' is pivoted in engagement direction 126 or in the disengagement direction 122 to urge the connector housings toward or away from each other, respectively. To this end, and with reference to FIG. 21, the lever 28' and connector housing 26' are further configured such that at the completion of the first stage of the alignment mode, each full gear tooth 168 is disposed relative to a respective full tooth 166 such that pivoting of the lever 28' in engagement direction 126 will cause each partial gear tooth 170 to pivot about a respective partial gear tooth 164, and each gear tooth 168 to mate with a respective gear tooth 166 in a second stage of the alignment mode. Such motion will urge the connector housings 22 and 26' towards each other in the same manner in that connector housings 22 and 26 are urged together by the mating of the generally V-shaped gear-like surface areas 112 and the generally V-shaped gear-like camming surface areas 80 as described above regarding FIGS. 10 and 11. Similarly, pivoting of the lever 28' in the disengagement direction 122 will cause each partial gear tooth 170 to pivot in an opposite direction about a respective partial gear tooth 164, and each full gear tooth 168 to disengage from a respective full gear tooth 166 in the second stage of alignment. Such motion will urge the connector housings 22 and 26' away from each other in the same manner in that connector housings 22 and 26 are urged apart as described above regarding FIGS. 10 and 11.

The cam projections 78' of the connector housing 26' and the lever 28' are further structured and arranged such that if the connector housings are in a misalignment mode when they are slidably engaged, then each segment 158 will engage a respective segment 154 thereby preventing pivoting of the lever in an engagement direction. To this end, and with reference to FIG. 22, the lever 28' and connector housing 26' are configured such that when the connector housings are not properly aligned when slidably engaged, each full gear tooth 168 will be positioned so as to engage a respective stop surface 162 thereby preventing each partial gear tooth 164 from mating with a respective partial gear tooth 170 and the lever 28' from pivoting in engagement direction 126 and mismating the connector housings. The engagement of each stop surface 162 and a respective gear tooth 168 will provide tactile feedback to the user indicating that the connector housings 22 and 26' are not properly aligned.

Fabrication of the connector assembly of the present invention may be accomplished using conventional procedures. For example, the connector housings 22 and 26, 26' and the lever 28, 28' may be molded from a plastic material.

The embodiments that have been described herein are but some of several that utilize this invention and are set forth here by way of illustration but not of limitation. It is apparent that many other embodiments that will be readily apparent to those skilled in the art may be made without departing materially from the spirit and scope of this invention.

We claim:

1. A connector assembly, comprising:

at least one first connector housing;

at least one second connector housing slidably engaging within said first connector housing, said second connector housing comprising a multi-surface first cam projection; and a lever pivotally supported on said first connector housing by at least one pivot element extending through a wall of said first connector housing, said pivot element comprising a first region that comprises a multi-surface second cam projection, said first and second cam projections being structured and arranged so that (a) at least a first surface area of said first cam projection will engage at least a first surface area of said second cam projection, when said first and second connector housings are in a misalignment mode thereby preventing pivoting of said lever in an engagement direction, (b) at least a second surface area of said first cam projection will mate with at least a second complimentary surface area of said second cam projection when said first and second connector housings are in a first stage of an alignment mode thereby permitting pivoting of said lever in said engagement direction, and (c) at least a third surface area of said first cam projection will mate with said first surface area of said second cam projection when said lever is pivoted in an engagement direction or in an opposite disengagement direction, respectively, in a second stage of said alignment mode, to urge said first and second connector housings towards or away from each other, respectively.

2. The connector assembly of claim 1 further comprising a mounting plate, said at least one second connector housing extending from said mounting plate.

3. A connector assembly, comprising:

a first connector housing comprising opposing first and second sidewalls;

a second connector housing comprising opposing third and fourth sidewalls, said third and fourth sidewalls slidably engaging within respective first and second sidewalls of said first connector housing, said third and fourth sidewalls each comprising a first cam projection comprising a first segment and a second segment; and a lever pivotally supported on said first and second sidewalls by respective first and second pivot elements extending through said first and second sidewalls, respectively, said first and second pivot elements each comprising a first region that includes a second cam projection comprising a third segment adapted to mate with said first segment but not with said second segment, and a fourth segment adapted to mate with said second segment, said segments being structured and arranged so that (a) each third segment will engage a respective of said second segments when said first and second connector housings are in a misalignment mode thereby preventing pivoting of said lever in an engagement direction, (b) each fourth segment will mate with a respective of said second segments in an alignment mode to permit pivoting of said lever in an engagement direction; and (c) subsequent to said alignment mode each third segment will mate with a respective of said first segments in an engagement and disengagement mode when said lever is pivoted in an engagement direction or in an opposite disengagement direction, respectively, to urge said first and second connector housings towards or away from each other, respectively, wherein said second segment is complimentary to said fourth segment.

4. The connector assembly of claim 3 further comprising a mounting plate, said second connector housing extending from said mounting plate.

5. A first connector for slidably engaging with a second connector, wherein the second connector comprises a second connector housing comprising a multi-surface first cam projection, the first connector comprising:

a first connector housing slidably engaging the second connector housing; and a lever pivotally supported on said first connector housing by at least one pivot element extending through a wall of said first connector housing, said pivot element comprising a first region that comprises a multi-surface second cam projection, said first and second cam projections being structured and arranged so that (a) at least a first surface area of said first cam projection will engage at least a first surface area of said second cam projection, when said first and second connector housings are in a misalignment mode thereby preventing pivoting of said lever in an engagement direction, (b) at least a second surface area of said first cam projection will mate with at least a second complimentary surface area of said second cam projection when said first and second connector housings are in a first stage of an alignment mode thereby permitting pivoting of said lever in said engagement direction, and (c) at least a third surface area of said first cam projection will mate with said first surface area of said second cam projection when said lever is pivoted in an engagement direction or in an opposite disengagement direction, respectively, in a second stage of said alignment mode, to urge said first and second connector housings towards or away from each other, respectively.

6. A second connector for slidably engaging with a first connector, wherein the first connector comprises a first connector housing and a lever pivotally supported on said first connector housing by at least one pivot element extending through a wall of said first connector housing, said pivot element comprising a first region that comprises a multi-surface second cam projection, said second connector comprising:

a second connector housing slidably engaging within said first connector housing, said second connector housing comprising a multi-surface first cam projection, wherein said first and second cam projections are structured and arranged so that (a) at least a first surface area of said first cam projection will engage at least a first surface area of said second cam projection, when said first and second connector housings are in a misalignment mode thereby preventing pivoting of said lever in an engagement direction, (b) at least a second surface area of said first cam projection will mate with at least a second complimentary surface area of said second cam projection when said first and second connector housings are in a first stage of an alignment mode thereby permitting pivoting of said lever in said engagement direction, and (c) at least a third surface area of said first cam projection will mate with said first surface area of said second cam projection when said lever is pivoted in an engagement direction or in an opposite disengagement direction, respectively, in a second stage of said alignment mode, to urge said first and second connector housings towards or away from each other, respectively.

* * * * *